US009127524B2

(12) United States Patent
Dahlem et al.

(10) Patent No.: US 9,127,524 B2
(45) Date of Patent: Sep. 8, 2015

(54) SUBSEA WELL INTERVENTION SYSTEM AND METHODS

(71) Applicants: Jason Dahlem, Houston, TX (US); Matthew Green, Katy, TX (US)

(72) Inventors: Jason Dahlem, Houston, TX (US); Matthew Green, Katy, TX (US)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 14/199,407

(22) Filed: Mar. 6, 2014

(65) Prior Publication Data

US 2014/0251633 A1 Sep. 11, 2014

Related U.S. Application Data

(60) Provisional application No. 61/776,211, filed on Mar. 11, 2013.

(51) Int. Cl.

| | |
|---|---|
| ***E21B 33/035*** | (2006.01) |
| ***E21B 29/04*** | (2006.01) |
| ***E21B 29/08*** | (2006.01) |
| ***E21B 33/06*** | (2006.01) |
| ***E21B 33/064*** | (2006.01) |
| ***E21B 34/04*** | (2006.01) |

(52) U.S. Cl.

CPC ..... *E21B 33/035* (2013.01); *E21B 29/04* (2013.01); *E21B 29/08* (2013.01); *E21B 33/063* (2013.01); *E21B 33/064* (2013.01); *E21B 34/04* (2013.01)

(58) Field of Classification Search

CPC ..... E21B 29/12; E21B 29/04; E21B 29/08; E21B 33/035; E21B 33/063; E21B 33/064; E21B 34/04

USPC ..... 166/368, 369, 363, 364, 297, 298

See application file for complete search history.

(56) References Cited

U.S. PATENT DOCUMENTS

| | | | | |
|---|---|---|---|---|
| 3,894,560 | A * | 7/1975 | Baugh | 137/606 |
| 4,109,712 | A | 8/1978 | Regan | |
| 4,215,749 | A | 8/1980 | Dare et al. | |
| 5,575,336 | A | 11/1996 | Morgan | 166/330 |

(Continued)

FOREIGN PATENT DOCUMENTS

| | | |
|---|---|---|
| EP | 0 895 907 B1 | 7/1992 |
| GB | 2 089 866 | 6/1982 |

(Continued)

OTHER PUBLICATIONS

Undisclosed, Subsea Trees, Oil and Gas Technologies, Aug. 9, 2002, http://oilandgastechnologies.wordpress.com/2012/08/09/subsea-trees/ (retrieved on Sep. 3, 2014).

*Primary Examiner* — James G Sayre

(74) *Attorney, Agent, or Firm* — Jayne C. Piana

(57) ABSTRACT

A system for performing an intervention on a subsea wellhead, the system including a production tree having a central axis, a first end, a second end, and a first flow bore extending axially from the first end to the second end. The production tree includes a master valve disposed along the first flow bore, a swab valve disposed along the first flow bore between the master valve and the first end, and a shearing device disposed along the first flow bore between the master valve and the second end. The second end of the production tree comprises a connector configured to releasably couple to the subsea wellhead, and the shearing device is configured to shear a component extending through the first flow bore.

8 Claims, 7 Drawing Sheets

(56) References Cited

U.S. PATENT DOCUMENTS

| | | | | |
|---|---|---|---|---|
| 5,873,415 | A * | 2/1999 | Edwards | 166/344 |
| 6,357,529 | B1 * | 3/2002 | Kent et al. | 166/344 |
| 7,025,132 | B2 * | 4/2006 | Kent et al. | 166/87.1 |
| 7,121,346 | B2 | 10/2006 | Wolff et al. | 166/348 |
| 7,225,873 | B2 * | 6/2007 | Schlegelmilch et al. | 166/298 |
| 2003/0145994 | A1 * | 8/2003 | Gatherar et al. | 166/339 |
| 2004/0026084 | A1 * | 2/2004 | Donald | 166/368 |
| 2005/0028980 | A1 | 2/2005 | Page et al. | |
| 2008/0257032 | A1 * | 10/2008 | Zollo et al. | 73/152.29 |
| 2010/0025044 | A1 | 2/2010 | McKay et al. | 166/359 |
| 2014/0209314 | A1 * | 7/2014 | Guven | 166/336 |
| 2015/0021043 | A1 * | 1/2015 | Harkins et al. | 166/377 |

FOREIGN PATENT DOCUMENTS

| | | |
|---|---|---|
| GB | 2 319 795 | 3/1998 |
| GB | 2 345 927 | 11/1999 |
| GB | 2 402 409 | 8/2004 |
| WO | WO-02/38912 | 5/2002 |
| WO | WO-2006/042031 | 4/2006 |
| WO | WO-2008/015387 | 2/2008 |

* cited by examiner

SUBSEA WELL INTERVENTION SYSTEM AND METHODS

CROSS-REFERENCE TO RELATED APPLICATIONS

This application claims the benefit of priority from U.S. Provisional Application No. 61/776,211, filed Mar. 11, 2013.

STATEMENT REGARDING FEDERALLY SPONSORED RESEARCH OR DEVELOPMENT

Not applicable.

BACKGROUND

The disclosure relates generally to subsea oil and gas wells. More particularly, the disclosure relates to intervention systems and methods for subsea oil and gas wells. Still more particularly, the disclosure relates to intervention systems and methods for subsea oil and gas wells employing a vertical production tree.

Conventionally, subsea wells are built up by installing a primary conductor in the seabed, securing a wellhead to the upper end of the primary conductor and, with a drilling blowout preventer (BOP) stack installed on the wellhead, drilling down through the BOP stack, wellhead, and primary conductor to produce a wellbore while successively installing concentric casing strings that line the wellbore. The casing strings are typically cemented and/or sealed with mechanical seals at their upper ends.

To convert the cased well for production, a production tubing string is run in through the BOP stack, and a tubing hanger at the upper end of the production tubing string is landed in a mating profile in the wellhead or the tubing spool. Thereafter, bores in the tubing hanger are temporarily closed, and the drilling BOP stack is removed. Next, a production tree having a production bore and associated valves is lowered subsea and mounted to the wellhead or tubing spool. The production tree includes a production outlet coupled to a flowline for producing hydrocarbons from the completed well. In particular, hydrocarbon fluids produced from the wellbore flow through the production tubing and production bore of the tubing hanger, through the production outlet of the tree, and through the flowline to a subsea architecture (e.g., manifold, production riser, etc.).

After completion and during production, it is often necessary to access the well to carry out various operations including, but not limited to, managing the production of oil or gas, altering the geometry or overall state of the well, allowing for various diagnostics to be run, etc. Such processes requiring access to the well after completion and production are often referred to as "intervention" operations. To ensure that the well can be sealed-off and isolated in the event of an emergency situation during an intervention, any intervention method includes, among other things the following three safety capabilities/functions—(1) a means for shearing off downhole components within the wellbore of the well; (2) a means for sealing off the wellbore; and (3) a means for disconnecting the intervention system and surface vessel from the wellhead equipment (e.g., the subsea tree, the wellhead, the tubing spool, etc.).

One traditional method of performing an intervention on a subsea well is to remove a production cap from the upper portion of the production tree and to lower and install a BOP stack on top of the production tree. The BOP stack generally includes a plurality of vertically stacked rams (e.g., blind and/or shear rams), an annular blowout preventer, and an emergency disconnect package (EDP) disposed at the upper end of the BOP stack. The annular blowout preventer and rams are actuatable to seal off the flowbore of the BOP stack. Next, a landing string with a pressure containing pipe, a subsea test tree (SSTT), and a tubing hanger running tool (THRT) is lowered from a surface vessel into the central flow bore of the BOP stack until the THRT is received within the upper end of the production tree. A shut-in or shear valve is located within the SSTT. This shear valve is typically a ball valve that is configured to shear off any coiled tubing or wireline extending through the SSTT in the event of an emergency. A flapper valve is also positioned within the SSTT above the shear valve, and functions to further seal off fluid flow to/from the production tree. Still further, a retainer valve is disposed within the SSTT, axially above both the flapper valve and the shear valve, and functions to retain any fluids within the SSTT and landing string therein in the event of an emergency disconnect.

During an intervention, an emergency situation requiring decoupling of the surface vessel from the wellhead equipment may arise. In such cases, the shear valve closes and cuts off coiled tubing and/or wireline extending through the SSTT. Next, the SSTT disconnects from just above the flapper valve (now closed) and the EDP disconnects from the BOP stack, thereby allowing the surface vessel (e.g., a rig) to move away from the well safely (i.e. without causing damage to the well).

While the above described intervention method has been employed with some success, there are several drawbacks. First, since the intervention method requires the use of a large and heavy BOP stack, a drilling rig with a sufficient lifting capacity is required to perform intervention operations. The expense and time required to secure a drilling rig is burdensome, and may result in a decision to forego the intervention entirely. Second, the bending stresses experienced by the wellhead are substantially increased by the added weight of the BOP stack once it is installed on top of the production tree, thereby potentially fatiguing the wellhead. These drawbacks are usually exacerbated as well pressure increases since high pressure wells typically require larger and heavier equipment. Third, if an emergency disconnect is performed during an intervention, the lower portion of the coiled tubing and/or wireline sheared off by the shear valve of the SSTT may not completely fall through the production tree and into the wellbore, thereby potentially forming an obstruction in the main flow bore of the production tree.

In some conventional surface production trees, shearing the components disposed within the wellbore during an emergency can be accomplished through actuation of one of the isolation valves within the production tree itself. However, such isolation valves are generally not specifically designed to shear metal objects, and thus, can experience significant damage if employed to shear objects passing therethrough. Such damage may undesirably inhibit the ability of the isolation valve to effectively seal. In subsea applications, if an isolation valve cannot maintain an effective seal it must be replaced before production operations may continue, and such subsea replacement necessitates the time consuming and costly retrieval of the entire production tree to the sea surface.

BRIEF SUMMARY OF THE DISCLOSURE

These and other needs in the art are addressed in one embodiment by a system for performing an intervention on a subsea well. In an embodiment, the system comprises a production tree having a central axis, a first end, a second end, and a first flow bore extending axially from the first end to the second end. The production tree includes a master valve disposed along the first flow bore, a swab valve disposed along the first flow bore between the master valve and the first end, and a shearing device disposed along the first flow bore between the master valve and the second end. The second end of the production tree comprises a connector configured to releasably couple to the subsea well. The shearing device is configured to shear a component extending through the first flow bore.

These and other needs in the art are addressed in another embodiment by a system for performing an intervention on a subsea well. In an embodiment, the system comprises a production tree having a central axis, a first end, a second end, a first flow bore extending axially from the first end to the second end, and a second flow bore extending radially from the first flow bore. The production tree includes a master valve disposed along the first flow bore, and a swab valve disposed along the first flow bore between the master valve and the first end. In addition, the system comprises an adapter module having a first end releasably coupled to the second end of the production tree, a second end configured to releasably coupled to the subsea well, a through bore extending from the first end of the adapter module to the second end of the adapter module, and a shearing device disposed along the through bore of the adapter module. The shearing device is configured to shear a component extending through the through bore.

These and other needs in the art are addressed in another embodiment by a method for performing an intervention operation on a subsea well disposed below a sea surface. In an embodiment, the method comprises isolating the subsea well with a subsea production tree disposed at an upper end of the subsea well, wherein the production tree has an upper end, a lower end, a vertical flow bore extending from the upper end to the lower end, and a substantially horizontal flow bore extending from the vertical flow bore. In addition, the method comprises lowering a landing string subsea from a vessel disposed at the sea surface, wherein the landing string includes a conduit, a running tool coupled to a lower end of the conduit, and a retainer valve disposed along the conduit proximal the lower end. Further, the method comprises coupling the landing string to the upper end of the production tree. Still further, the method comprises allowing fluid communication between the subsea well and the conduit through the vertical flow bore. Also, the method comprises lowering an intervention component through the conduit and the production tree into the subsea well.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the disclosure, reference will now be made to the accompanying drawings in which.

DETAILED DESCRIPTION OF THE PREFERRED EMBODIMENTS

Figure 1:
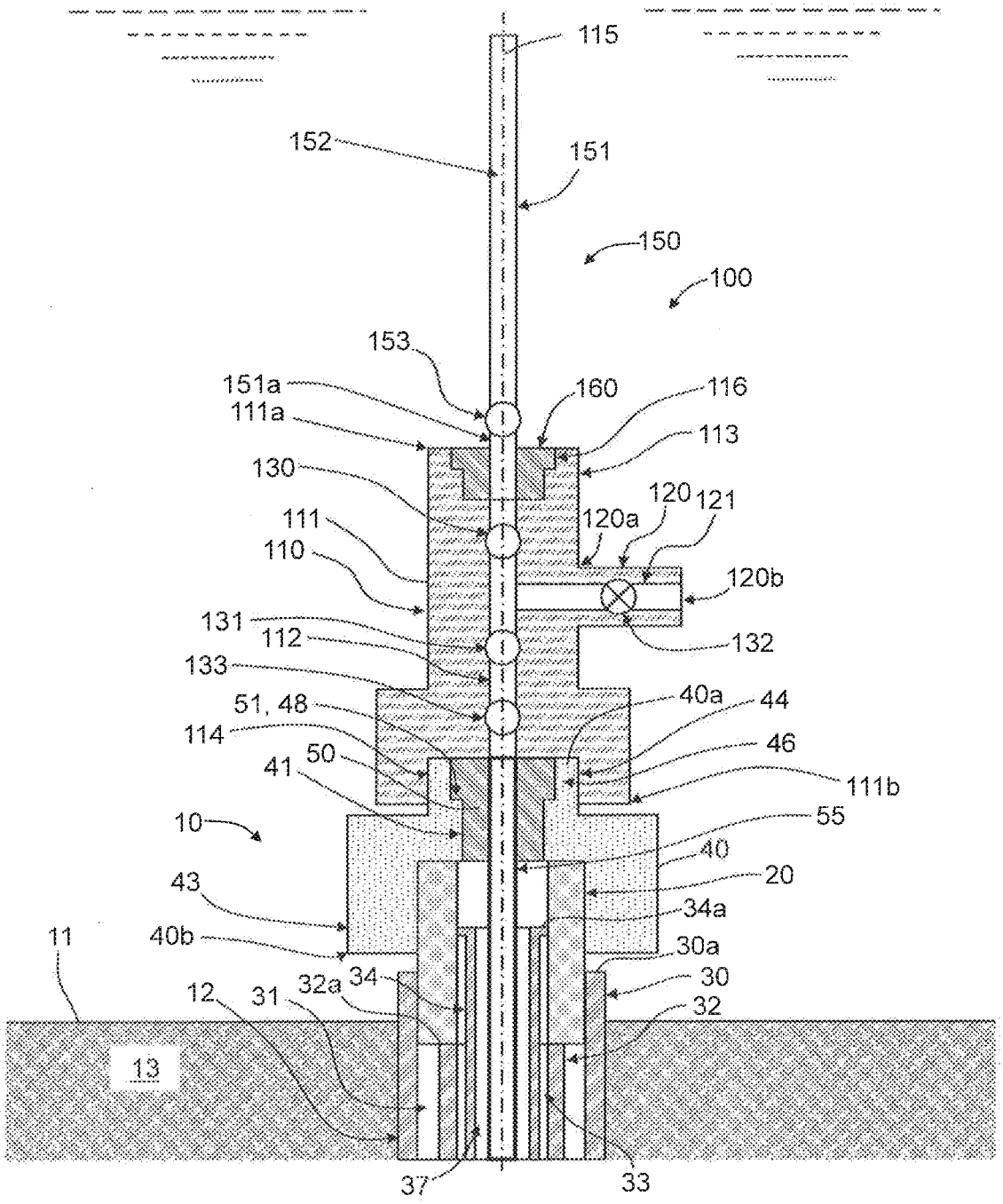
FIG. 1 is a schematic cross-sectional view of an embodiment of a subsea intervention system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Further, as used herein, the terms "generally", "substantially", and "approximately" mean plus or minus 10 percent. Still further, as used herein, the term "wireline" refers to braided line, electric line, slickline or the like.

Referring now to FIG. 1, an embodiment of a system 100 for performing an intervention operation on a subsea well 10 is shown. Subsea well 10 extends downward through the sea floor 11 into a wellbore 12 for producing hydrocarbons therefrom. In this embodiment, subsea well 10 includes a primary conductor 30 extending downhole from the sea floor 11, a wellhead 20 coupled to the primary conductor 30, a surface casing 32 suspended from wellhead 20, a production casing 34 also suspended from wellhead 20, and a tubing spool 40 mounted to wellhead 20. In this embodiment, primary conductor 30, wellhead 20, surface casing 32, production casing 34, tubing spool 40, and wellbore 12 are all coaxially aligned. Primary conductor 30 extends downward from the sea floor 11 and lines wellbore 12. Thus, primary conductor 30 is an elongate tubular having a first or upper end 30*a* disposed above the sea floor 11, a second or lower end (not shown) disposed in the sea bed, and a central throughbore 31 extending therebetween. Wellhead 20 is disposed within the primary conductor 30 at the upper end 30*a*, just above the sea floor 11. Additionally, surface casing 32 is an elongate tubular having a first or upper end 32*a* disposed within the wellhead 20, a second or lower end (not shown) disposed downhole, and a central throughbore 33 extending therebetween. Further, production casing 34 is also an elongate tubular having a first or upper end 34*a* disposed within the wellhead 20, a second or lower end (not shown) disposed downhole, and a central throughbore 37 extending therebetween.

Tubing spool 40 is mounted to wellhead 20 and has a first or upper end 40*a*, a second or lower end 40*b*, and a central throughbore 41 extending between ends 40*a*, 40*b*. Lower end 40*b* comprises a downward-facing female connector 43 releasably connected to and sealingly engaging wellhead 20, and upper end 40*a* comprises an upward-facing male connector or hub 44. Throughbore 41 includes an annular recess 46 extending from upper end 40*a* to an annular landing shoulder 48. A tubing hanger 50 is disposed in throughbore 41 and includes an outer annular landing shoulder 51 seated against shoulder 48, and a tubing string 55 suspended from hanger 50 and extending downward into throughbore 37 of production casing 34.

Referring still to FIG. 1, system 100 includes a vertical mono-bore production tree 110 and an open water landing string 150. As will be described in more detail below, production tree 110 is releasably connected to tubing spool 40, and landing string 150 is releasably connected to production tree 110. Tree 110 and string 150 are coaxially aligned with well 10 when coupled together as shown in FIG. 1.

Production tree 110 includes a main body 111 and a wing block 120 extending radially outward from body 111. Body 111 has a central axis 115, a first or upper end 111*a*, a second or lower end 111*b* opposite the upper end 111*a*, and a vertical flow bore 112 extending axially between ends 111*a*, 111*b*. In this embodiment, upper end 111*a* comprises an upward-facing male connector or hub 113 and lower end 111*b* comprises a downward-facing female connector 114 that releasably connects to and sealingly engages hub 44 of tubing spool 40. In addition, an upward-facing female receptacle 116 is disposed at upper end 111*a* in hub 113. As will be described in more detail below, the lower end of landing string 150 is removably and sealingly engaged in receptacle 116 and releasably connected to upper end 111*a*. In general, connector 114 and hubs 113, 44 may comprise any suitable releasable wellhead-type connector including, without limitation, the H-4® profile available from VetcoGray Inc. of Houston, Tex.

Wing block 120 includes a first radially inner end 120*a* integral with body 111 and a second or radially outer end 120*b* distal body 111. A horizontal production flow bore or outlet 121 extends radially from vertical flow bore 112 through body 111 and wing block 120 to end 120*b*. Outer end 120*b* is configured to releasably couple to other subsea components, such as, for example, a flowline, a manifold, etc.

Referring still to FIG. 1, tree 110 also includes a plurality of valves—a master valve 131, a swab valve 130, a wing valve 132, and a shearing mechanism or device 133. Valves 130, 131 are disposed along flow bore 112 on opposite sides of flow bore 121. Namely, valve 131 is positioned along flow bore 112 between lower end 111*b* and flow bore 121, and valve 130 is positioned along flow bore 112 between upper end 111*a* and flow bore 121. Thus, valve 131 controls fluid communication between tubing string 55 and flow bore 121, and valve 130 controls fluid communication between landing string 150, flow bore 121, and tubing string 55. Valve 132 is disposed along flow bore 121 between flow bore 112 and end 120*b*, and thus, controls fluid flow through wing block 120. In general, each valve 130, 131, 132 can be any suitable valve known in the art for sealing off fluid flow within a flow passage including, without limitation, a ball valve, a gate valve, or the like.

Shearing device 133 is disposed along flow bore 112 between valve 131 and lower end 111*b*. As will be described in more detail below, device 133 functions to shear components extending therethrough (e.g., coiled tubing, wireline, etc.), and thus, can be any type of shearing device known in the art for shearing downhole components including, without limitation, a ball valve or a gate valve. In general, valves 130, 131, 132, and device 133 may be actuated, independently or in groups of two or more, by any suitable means known in the art. For example, valves 130, 131, 132, and device 133 can be actuated by a subsea remote operated vehicle (ROV), an electronic or hydraulic actuator, etc. Moreover, valves 130, 131, 132, and device 133 can be controlled from the surface and/or subsea.

Referring still to FIG. 1, open water landing string 150 is releasably connected to production tree 110 at upper end 111*a*. In this embodiment, landing string 150 includes an elongate conduit 151 and a running tool 160. Conduit 151 is a rigid tubular having a first or lower end 151*a*, a second or upper end (not shown) coupled to a surface vessel (not shown) at the sea surface, and a flow passage 152 extending therebetween. A retainer valve 153 is disposed along flow passage 152 proximal lower end 151*a*. In general, retainer valve 153 can be any suitable valve known in the art for sealing off the flow within flow passage including, without limitation, a ball valve, a flapper valve. As will be described in more detail below, valve 153 may also function to shear coiled tubing and/or wireline disposed in flow passage 152 during intervention operations.

Running tool 160 is coupled to lower end 151*a* and is configured to releasably connect and sealingly engage receptacle 116 of production tree 110. Thus, running tool 160 enables landing string 150 to releasably connect to production tree 110.

Figure 2:
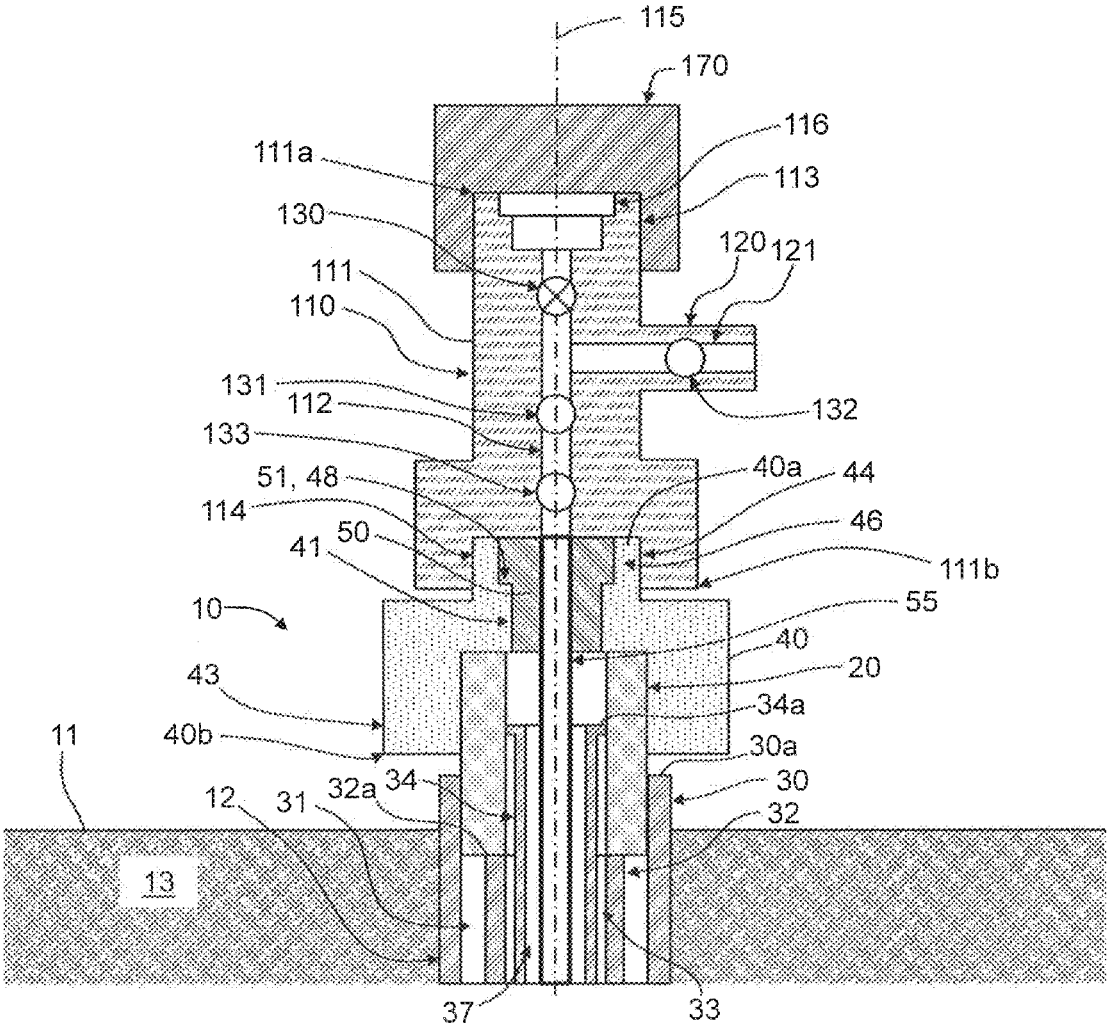
FIGS. 2-4 are sequential schematic cross-sectional views of an intervention operation performed with the system of FIG. 1.
Figure 3:
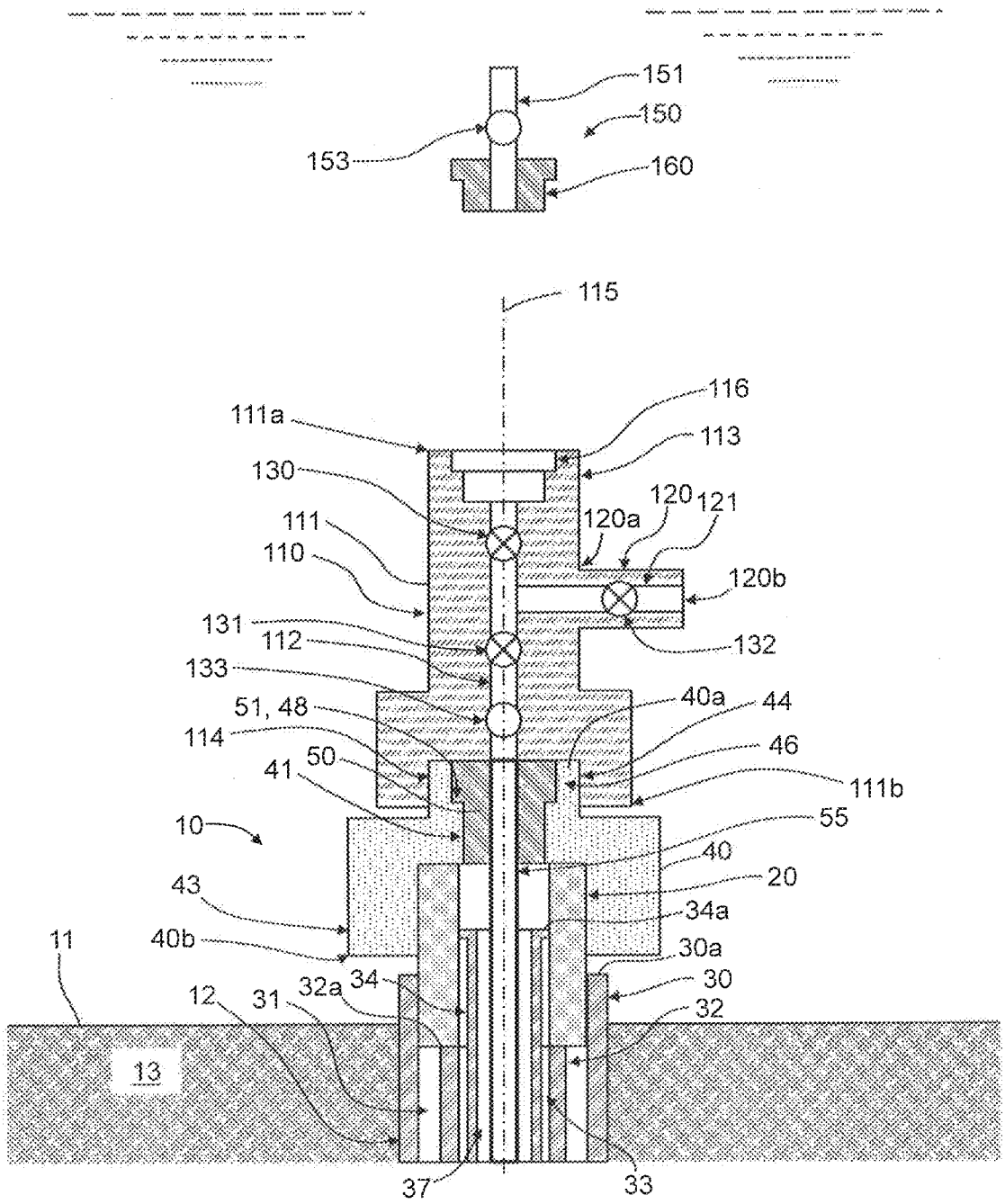
Figure 4:
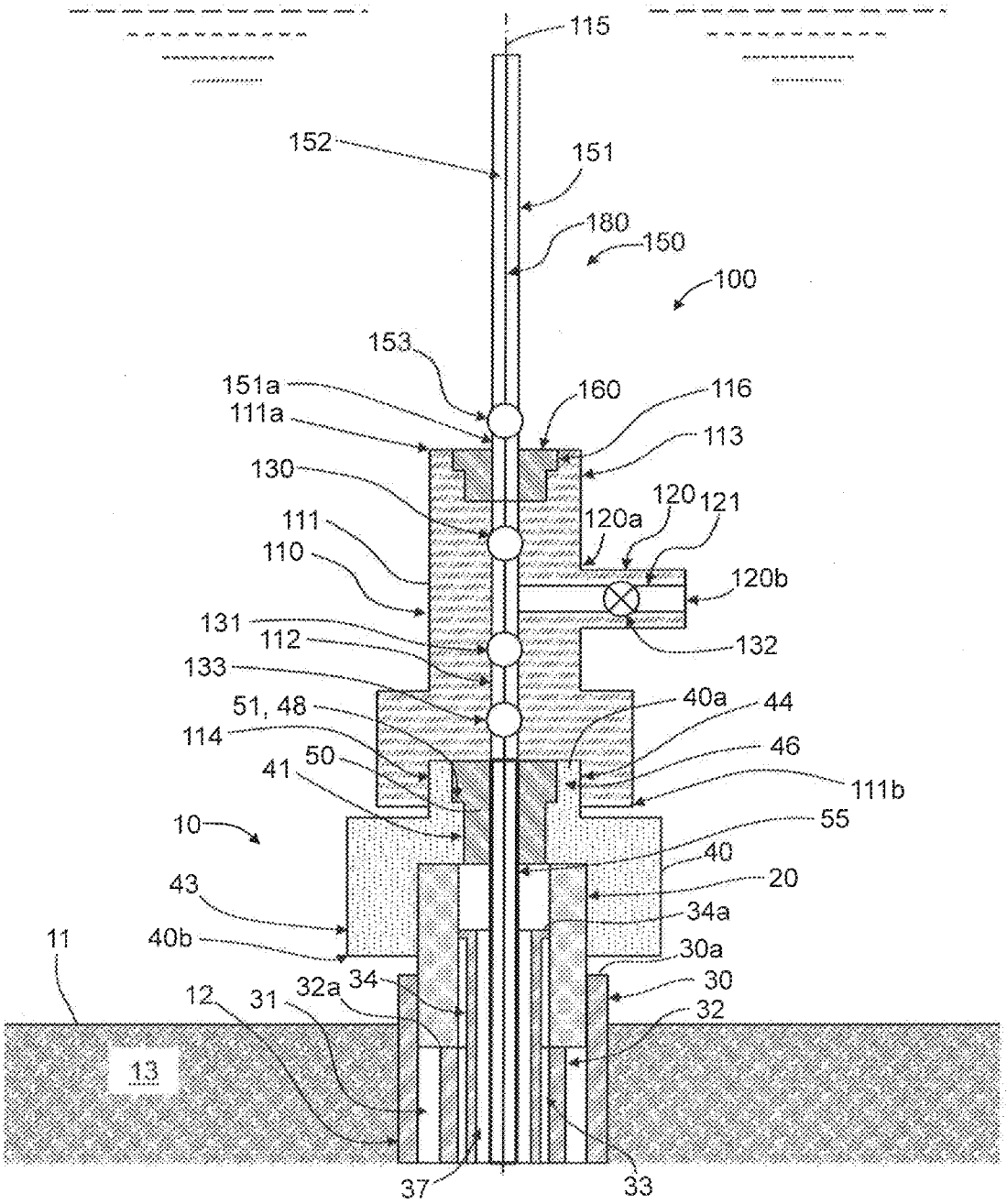

Referring now to FIGS. 2-4, an intervention procedure utilizing system 100 is shown. In particular, FIGS. 2-4 illustrate the basic steps of the intervention procedure, it being understood that additional and/or intermediate steps may be performed in compliance with standard engineering practices and/or government regulations. As previously described, an intervention is generally performed to, for example, alter the state of the well, run diagnostics on the well, or manage the production flowing from the well.

Referring first to FIG. 2, during normal production operations, vertical flow bore 112 is closed off with a production cap 170 releasably connected to hub 113 of production tree 110 and valve 130 is closed to prevent fluid flow therethrough. However, valves 131, 132, and device 133 are open, thereby allowing hydrocarbons to be produced through tubing string 55, vertical flow bore 112 and horizontal flow bore 121.

Moving now to FIG. 3, to perform an intervention operation, well 10 is closed off and isolated by closing valves 131 and 132. As previously described, valve 130 is already closed during normal production operations. Next, production cap 170 is removed from upper end 111*a*, and the open water landing string 150 is lowered subsea towards production tree 110.

Referring now to FIG. 4, once the landing string 150 is lowered to production tree 110, it is coaxially aligned with tree 110 and coupled thereto via receipt and locking of running tool 160 within receptacle 116 of production tree 110. Alignment of landing string 150 within tree 110 is accomplished, in at least some embodiments, with a funnel guide and/or gasket protectors disposed at the upper end 111*a* With running tool 160 seated in receptacle 116 and locked therein, an annular seal is formed between running tool 160 and production tree 110, thereby isolating fluids within the upper portion of flow bore 112 and flow passage 152 from the surrounding environment.

Once landing string 150 securely connected to production tree 110, valves 130, 131 are opened, as well as valve 153 if not already opened, such that fluid communication between the surface vessel (not shown) and tubing string 55 via landing string 150 and production tree 110 is established. Thereafter one or more intervention members or components 180 such as, for example, piping, coiled tubing or wireline, is run from the surface vessel, through landing string 150 and production tree 110 into tubing string 55. The specific components being run into the well 10 will vary depending on the specific purpose of the intervention. For example, if the intervention is being carried out in order to pump chemicals, such as acid, directly to the bottom of the wellbore, then coiled tubing may be run into the well 10 in the manner described above, such that the chemicals may be pumped therethrough.

During intervention operations, it may become necessary to quickly disconnect the surface vessel from the well (e.g., well 10). For example, if there is a need for the surface vessel to flee or avoid inclement weather (e.g., a hurricane) or the dynamic positioning system of the surface vessel fails, it may be necessary to shear any components in the production flow bore (e.g., component 180 within flow bore 112), seal off the well, and quickly disconnect therefrom.

Figure 5:
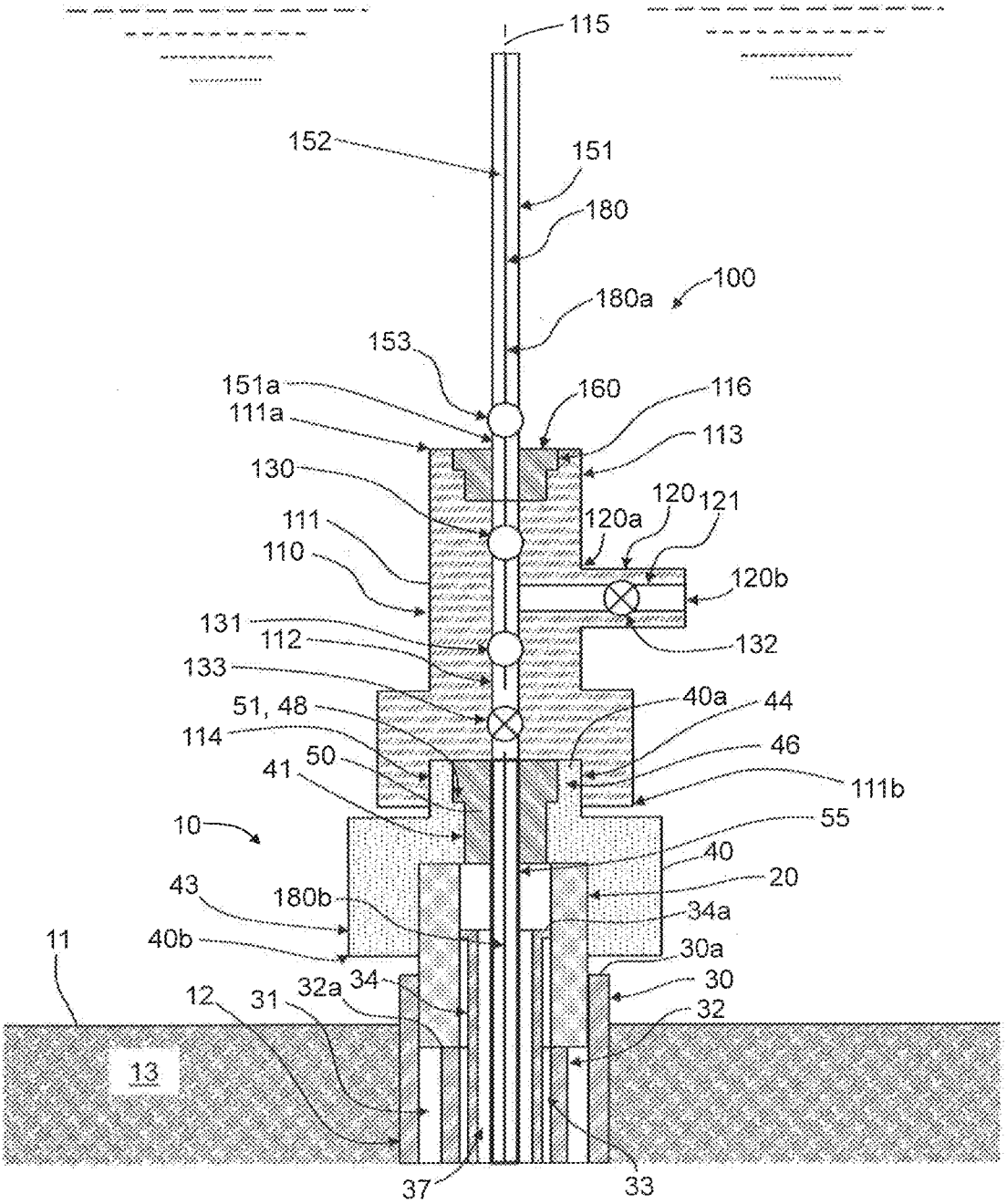
FIGS. 5 and 6 are sequential schematic cross-sectional views of a rapid disconnect procedure performed with the system of FIG. 1.

Referring now to FIG. 5, if an emergency situation develops during an intervention operation that necessitates a rapid disconnection from well 10, shearing device 133 is actuated to shear off component 180 disposed in flow bore 112. In some embodiments, valve 153 may also be actuated to shear off component 180. As a result, component 180 is divided into a first or upper portion 180*a* coupled to the surface vessel (not shown), and a second or lower portion 180*b* decoupled from the surface vessel and generally allowed to fall downward through tubing string 55. Next, upper portion 180*a* of intervention component 180 is lifted upward through the production tree 110 and into landing string 150 above the retainer valve 153.

Figure 6:
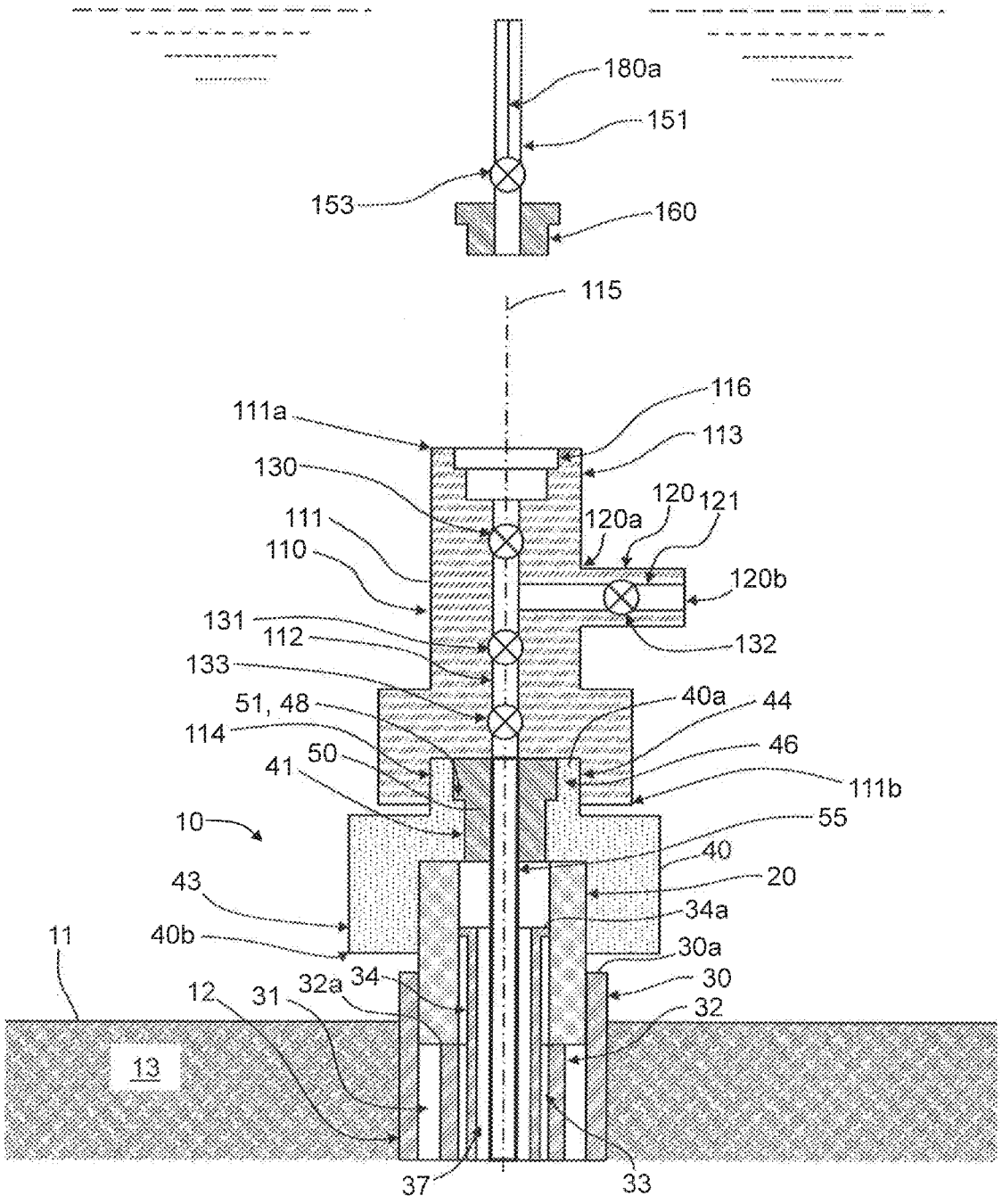

Referring now to FIG. 6, with upper portion 180*a* of intervention member 180 clear of valves 130, 131, they are closed to seal off well 10 from the surrounding environment. Retainer valve 153 within landing string 150 is also closed to prevent any fluids within flow passage 152 from flowing into the surrounding environment through lower end 150*a*. Thereafter, running tool 160 is disconnected from production tree 110 thereby allowing the surface vessel to move away from the well safely.

Figure 7:
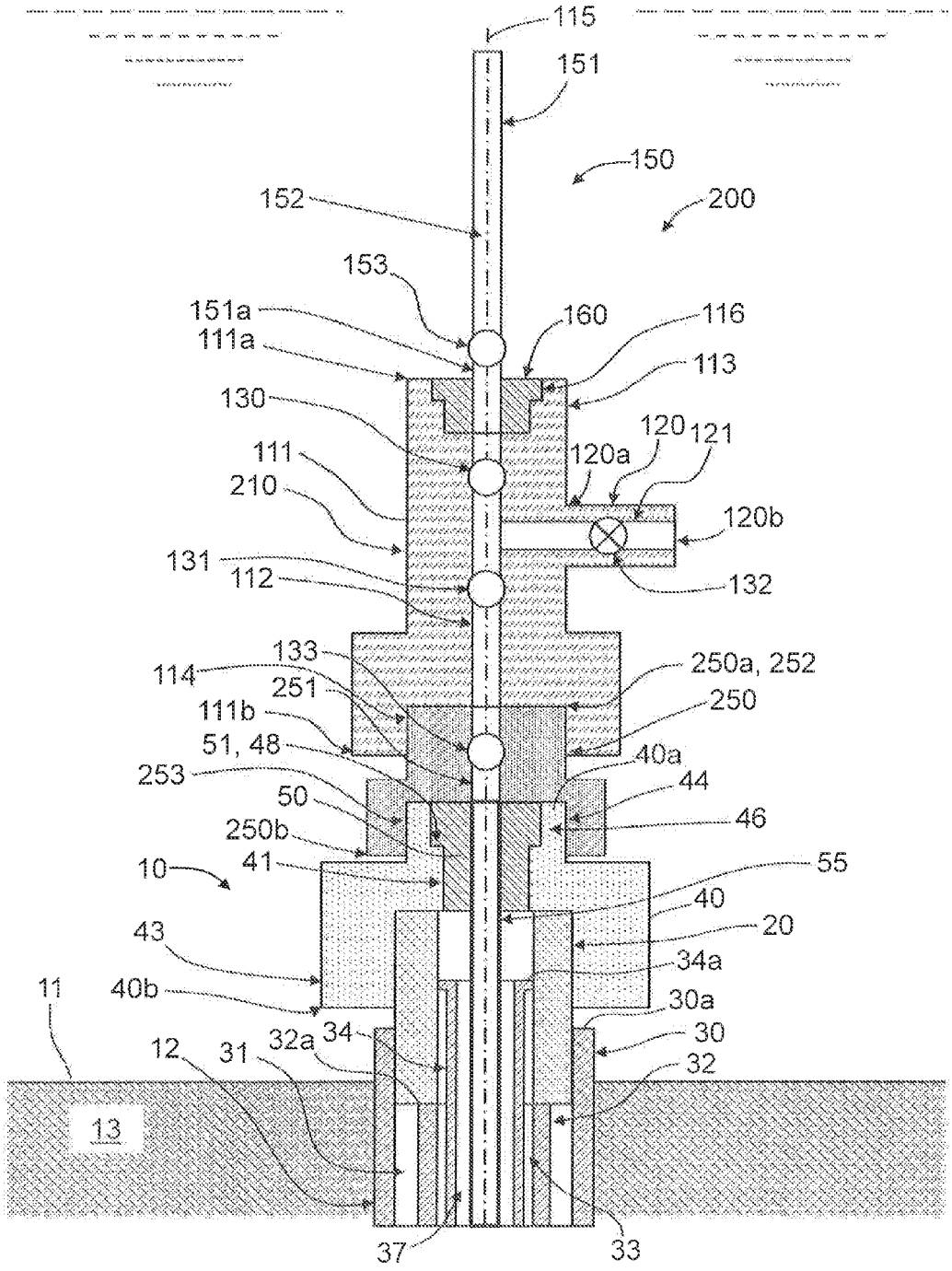
FIG. 7 is a schematic cross-sectional view of an embodiment of a subsea intervention system in accordance with the principles described herein.

Referring now to FIG. 7, another embodiment of a system 200 for performing a subsea intervention on well 10 as previously described is shown. System 200 includes an open water landing string 150 as previously described, a vertical mono-bore production tree 210, and an adapter module 250. Landing string 150 is releasably connected to tree 210. Module 250 is positioned between and releasably connected to tree 210 and spool 40.

Production tree 210 is substantially the same as production tree 110 previously described, except shearing device 133 is not included in the design of tree 210. In this embodiment, shearing device 133 is provided in module 250 instead of tree 210. More specifically, adapter module 250 has a first or upper end 250*a*, a second or lower end 250*b*, and a vertical through bore 251 extending between ends 250*a*, 250*b*. Shearing device 133 is positioned along bore 251. When device 133 is open, bore 251 provides unobstructed fluid communication between tubing string 55 and vertical flow bore 112. Upper end 250*a* comprises an upward-facing male connector or hub 252 releasably connected to and sealingly engaging female connector 114 of tree 210, and lower end 250*b* comprises a downward-facing female connector 253 releasably connected to and sealingly engaging hub 44 of spool 40. Thus, production tree 210 is coupled to spool 40 via adapter module 250.

Inclusion of shearing device 133 in adapter module 250 may enable retrofitting of some conventional vertical mono-bore production trees. Further, inclusion of shearing device 133 in adapter module 250 also allows replacement of device 133 (e.g., if it becomes damaged during a shearing operation) without replacing the entire production tree 210, even though, in some embodiments, tree 210 will need to be removed from module 250 in order to access and/or replace module 250.

During intervention operations, system 200 functions in the same way as system 100. Specifically, well 10 is closed off and isolated by closing valves 131 and 132. As previously described, valve 130 is already closed during normal production operations. Next, production cap 170 is removed from upper end 111*a*, open water landing string 150 is lowered subsea towards production tree 210, and landing string 150 is connected to production tree 210 at upper end 111*a* with running tool 160. Next, the valves 130, 131, 153, are all opened to provide a flow path from the surface vessel to tubing string 55, and intervention members or components (e.g., component 180) are run into tubing string 55. In the event of an emergency situation, the shearing device 133 disposed within module 250 is closed to shear off any components (e.g., component 180) disposed within flow bore 112, the upper portion of the sheared component is pulled upward into landing string 150, and the lower portion of the component is allowed to fall into tubing string 55. Next, the valves 130, 131, 153 are closed, and landing string 150 is disconnected from the production tree 210 thereby allowing the surface vessel to move away from the well safely.

As compared to some conventional intervention systems that include a BOP stack, embodiments of intervention systems disclosed herein (e.g., systems 100, 200) are relatively compact, simple, and lightweight. Consequently, embodiments of intervention systems disclosed herein can be deployed and operated with smaller surface vessels. More specifically, a drilling rig may not be required to carry out intervention operations utilizing systems disclosed herein, thereby enabling the use of lower cost, more accessible surface vessels. In addition, the reduced weight of embodiments of intervention systems disclosed herein offers the potential to reduce bending moments exerted on the wellhead during intervention operations. Further, embodiments disclosed herein allow coiled tubing or wireline disposed within the vertical flow bore of the production tree to be sheared off below the other valves in the production tree, thereby allowing the lower portion of the sheared component to more reliably fall into the tubing string and avoid interference with other isolation valves in the production tree. Still further, while some embodiments disclosed and described herein have included a module 250, housing a shearing device 133, that is axially disposed below the subsea tree 210, it should be appreciated that in other embodiments, the shearing device 133 may be disposed within a module that is configured to be inserted and installed within the subsea tree (e.g., tree 110, 210) while still complying with the principles disclosed herein.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for performing an intervention on a subsea well, the system comprising:

a production tree having a central axis, a first end, a second end, a first flow bore extending axially from the first end to the second end, and a second flow bore extending radially from the first flow bore;

wherein the production tree includes a master valve disposed along the first flow bore, and a swab valve disposed along the first flow bore between the master valve and the first end; and an adapter module having a first end releasably coupled to the second end of the production tree, a second end configured to releasably coupled to the subsea well, a through bore extending from the first end of the adapter module to the second end of the adapter module, and a shearing device disposed along the through bore of the adapter module, wherein the shearing device is configured to shear a component extending through the through bore.

2. The system of claim 1, wherein the production tree includes a wing valve disposed along the second flow bore.

3. The system of claim 1, further comprising a landing string configured to releasably connect to the first end of the production tree.

4. The system of 3, wherein the landing string comprises an elongate conduit having a lower end, a running tool coupled to the lower end, and a retainer valve disposed along the conduit proximal the lower end;

wherein the running tool is configured to releasably connect to the first end of the production tree.

5. A method for performing an intervention operation on a subsea well disposed below a sea surface, the method comprising:

(a) isolating the subsea well with a subsea production tree disposed at an upper end of the subsea well, wherein the production tree has an upper end, a lower end, a vertical flow bore extending from the upper end to the lower end, and a substantially horizontal flow bore extending from the vertical flow bore;

(b) lowering a landing string subsea from a vessel disposed at the sea surface, wherein the landing string includes a conduit, a running tool coupled to a lower end of the conduit, and a retainer valve disposed along the conduit proximal the lower end;

(c) coupling the landing string to the upper end of the production tree;

(d) allowing fluid communication between the subsea well and the conduit through the vertical flow bore; and (e) lowering an intervention component through the conduit and the production tree into the subsea well;

(f) closing a shearing device positioned below the first valve and the second valve; and (g) shearing an elongate support member coupling the intervention tool to the surface vessel with the shearing device.

6. The method of claim 5, wherein the shearing device is disposed in the production tree along the vertical flow bore.

7. The method of claim 5, wherein the shearing device is disposed in an adapter module disposed between the well and the production tree.

8. The method of claim 5, further comprising:

(h) lifting an upper portion of the sheared support member into the landing string;

(i) isolating the well with the production tree after (h);

(j) closing the retainer valve; and (k) decoupling the landing string from the production tree after (j).

* * * * *